United States Patent [19]

Park

[11] Patent Number: 4,589,932

[45] Date of Patent: May 20, 1986

[54] ALUMINUM 6XXX ALLOY PRODUCTS OF HIGH STRENGTH AND TOUGHNESS HAVING STABLE RESPONSE TO HIGH TEMPERATURE ARTIFICIAL AGING TREATMENTS AND METHOD FOR PRODUCING

[75] Inventor: Bom K. Park, Monroeville, Pa.

[73] Assignee: Aluminum Company of America, Pittsburgh, Pa.

[21] Appl. No.: 462,712

[22] Filed: Feb. 3, 1983

[51] Int. Cl.[4] ..... C22F 1/04

[52] U.S. Cl. ..... 148/12.7 A; 148/159; 148/417; 148/439

[58] Field of Search ..... 148/12.7 A, 11.5 A, 148/159, 417, 439

[56] References Cited

U.S. PATENT DOCUMENTS

| | | | |
|---|---|---|---|
| 2,614,053 | 10/1952 | Bobb et al. | 148/12.7 |
| 3,133,796 | 5/1964 | Craig, Jr. | 29/197.5 |
| 3,306,787 | 2/1967 | Dies | 148/32 |
| 3,418,177 | 12/1968 | Pryor | 148/11.5 |
| 3,563,815 | 2/1971 | Meier et al. | 148/12.7 |
| 3,594,133 | 7/1971 | Cote et al. | 29/183 |
| 3,645,804 | 2/1972 | Ponchel | 148/128 |
| 3,879,194 | 4/1975 | Morris et al. | 75/147 |
| 3,935,007 | 1/1976 | Baba et al. | 75/142 |
| 3,945,861 | 3/1976 | Anderson et al. | 148/12.7 |
| 4,000,007 | 12/1976 | Develay et al. | 148/2 |
| 4,042,424 | 8/1977 | Nicoud | 148/12.7 |
| 4,082,578 | 4/1978 | Evancho et al. | 148/12.7 |
| 4,113,472 | 9/1978 | Fister, Jr. et al. | 75/142 |
| 4,256,488 | 3/1981 | Livak | 75/142 |

*Primary Examiner*—R. Dean

*Attorney, Agent, or Firm*—Carl R. Lippert

[57] ABSTRACT

Improved aluminum alloy products are fabricated from an improved alloy broadly containing 0.4 to 1.2% silicon, 0.5 to 1.3% magnesium, 0.6 to 1.1% copper and 0.1 to 1% manganese. The alloy is treated at very high temperatures, approaching the solidus or initial melting temperature, to provide the improved performance. Thereafter, the alloy is shaped as by rolling, extruding, forging and other known aluminum wrought product-producing operations. In the solution heat treated, quenched and artificially aged temper products so produced exhibit very high strength in comparison with 6XXX aluminum alloys, together with very high toughness and impact and dent resistance along with substantial corrosion resistance properties. In addition, the artificial aging response of the improved products enables use of high temperature, low cost aging treatments without risk of overshooting or undershooting the required or desired properties.

80 Claims, 4 Drawing Figures

ALUMINUM 6XXX ALLOY PRODUCTS OF HIGH STRENGTH AND TOUGHNESS HAVING STABLE RESPONSE TO HIGH TEMPERATURE ARTIFICIAL AGING TREATMENTS AND METHOD FOR PRODUCING

BACKGROUND OF THE INVENTION

The present invention relates to high strength aluminum alloy products such as vehicular panels and other structural members useful in general and sporting goods applications and to improved methods for producing the same. In general, heat treatable aluminum alloys have been employed in a number of applications involving relatively high strength such as vehicular members, sporting goods and other applications. Aluminum Alloys 6061 and 6063 are among the largest selling, if not the largest selling, heat treatable alloys in the United States, with 6061 alloy being provided for sheet, plate and forging applications, and Alloy 6063 being provided for extrusions. The sales limits for these alloy compositions are:

TABLE I

| Alloy | Si | Mg | Cu | Cr | Mn | Fe | Zn |
|---|---|---|---|---|---|---|---|
| 6061 | .4–.8 | .8–1.2 | .15–.40 | .04–.35 | .15 max. | .7 max. | .25 max. |
| 6063 | .2–.6 | .45–.9 | .10 max. | .10 max. | .10 max. | .35 max. | .10 max. |

Alloy 6261 is generally similar in sales limits to the 6061 sales limits indicated above, except that it contains 0.2–0.35% Mn and limits Cr to 0.10% max. as an impurity. As in most aluminum alloys, the actual manufacturing limits for composition are typically narrower than the sales limits. These heat treatable 6XXX type alloys are well known for their useful strength and toughness properties in both T4 and T6 tempers and are generally considered as having relatively good corrosion resistance which makes them advantageous even over the very high strength and more expensive 7XXX alloys which sometimes can exhibit more corrosion than 6XXX alloys. Typical properties for these alloys in the longitudinal direction, including yield strength (YS), tensile strength (TS) and elongation (EL) for both the T4 and T6 tempers are as follows:

TABLE II

| Alloy | YS | TS | EL % |
|---|---|---|---|
| | T4 TEMPER | | |
| 6061 | 21 | 35 | 22 |
| 6063 | 13 | 25 | 22 |
| | T6 TEMPER | | |
| 6061 | 40 | 45 | 12 |
| 6063 | 31 | 35 | 12 |

As is known, the T4 condition refers to a solution heat treated and quenched condition naturally aged to a substantially stable property level, whereas the T5 and T6 tempers refer to a stronger condition produced by artificially aging at typical temperatures of 220°–350° or 400° F. for a typical period of hours.

Recently, Alloys 6009 and 6010 have been used as vehicular panels in cars, boats, and the like. These alloys and products thereof are described in U.S. Pat. No. 4,082,578, issued Apr. 4, 1978 to Evancho et al. Alloy 6010 sales limits are 0.8 to 1.2% Si, 0.6 to 1% Mg, 0.15 to 0.6% Cu, 0.2 to 0.8% Mn, balance essentially aluminum, and Alloy 6010 generally conforms to Alloy Type I in said U.S. Pat. No. 4,082,578. Alloy 6009 sales limits are the same except for lower Si at 0.6 to 1% and lower Mg at 0.4 to 0.6%, and Alloy 6009 generally conforms to Alloy Type II in said U.S. Pat. No. 4,082,578. In spite of the usefulness of the aforementioned alloys, there exists room for improvement, especially in the areas of strength, toughness and impact and dent resistance. Adding more strengthening elements such as copper, manganese, magnesium, or silicon or zinc has been suggested from time to time, but it is recognized that such can introduce more problems in corrosion performance, manufacture or other areas. For instance, adding substantial amounts of copper to the above-mentioned alloys would be considered to seriously impair corrosion and other performance aspects. One such alloy, Alloy 6066, is heavily loaded with supposedly strengthening elements such as copper and manganese, yet is seriously lacking in toughness and impact properties so as to be seriously impaired for use in structural applications requiring durability.

The present invention provides for improved products in sheet, plate, extruded and other forms utilizing a single aluminum alloy produced as herein provided and which solves various problems, including improved strength over 6061 and 6063 type alloys and improved impact and dent resistance and toughness over the newer 6009 and 6010 type alloys, together with other advantages in more stable aging response and still more advantages as will appear hereinbelow.

SUMMARY OF THE INVENTION

In accordance with the present invention, improved aluminum wrought alloy products are provided from an alloy consisting essentially of 0.4–1.2% silicon, 0.5 to 1.3% magnesium, 0.6 to 1.1% copper, 0.1 to 1% manganese, the balance being aluminum and incidental elements and impurities. The alloy is heated to a temperature which is very high for the particular composition, the temperature approaching the initial melting or solidus temperature for the alloy. Thereafter, the alloy is worked into wrought products capable of further fabrication into various useful articles. The improved products exhibit a stable high temperature aging curve which renders the alloy much more tolerant to time deviations during high temperature aging processes to provide further assurance of achieving the desired high properties.

DETAILED DESCRIPTION OF THE PREFERRED EMBODIMENTS

Figure 1:
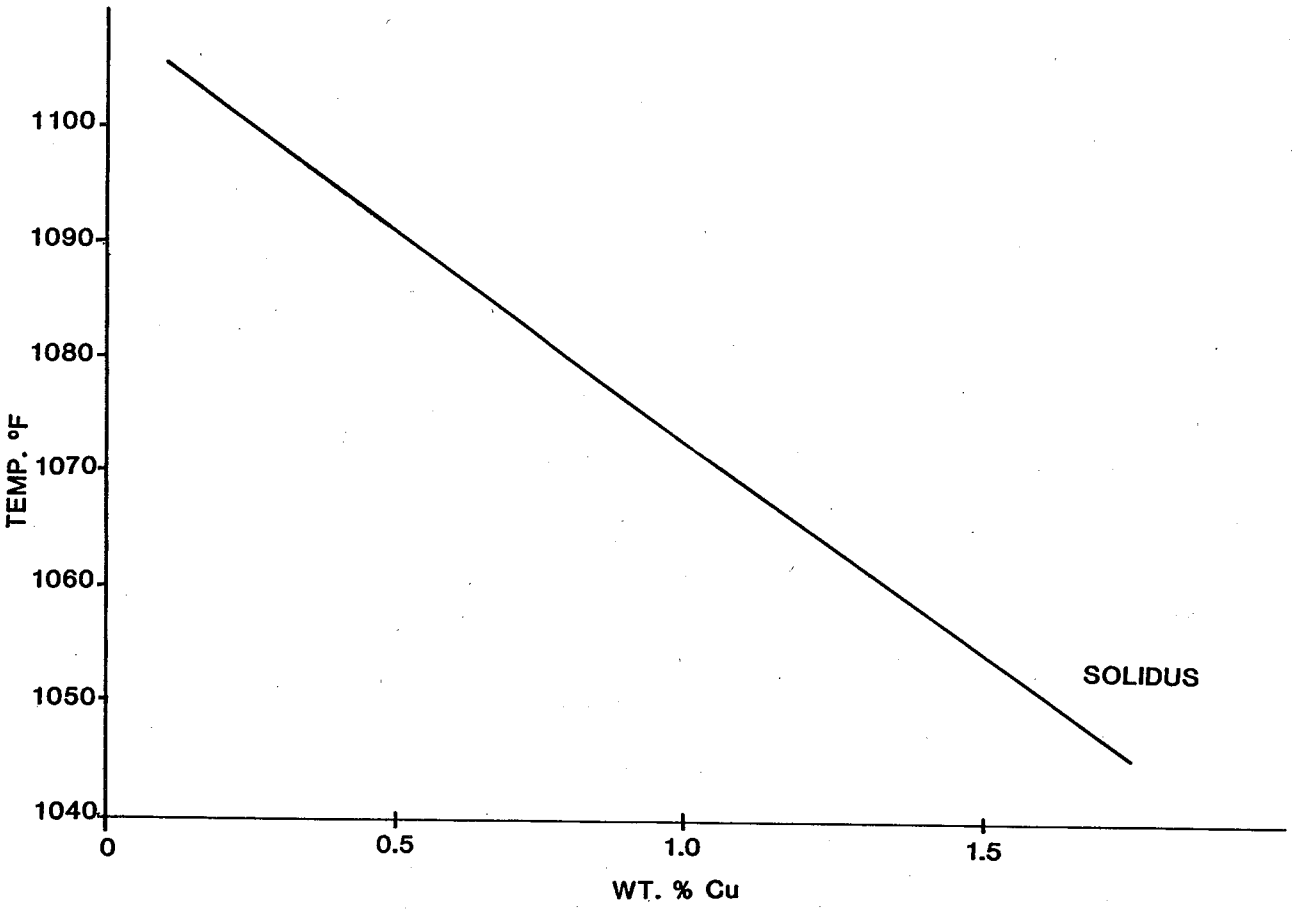
FIG. 1 is a graph plotting solidus temperature versus copper content.

The improved alloy according to the invention contains silicon, magnesium, copper and manganese, the balance being aluminum and incidental elements and impurities. The silicon content ranges broadly from 0.4 to 1.2%, all percentages herein being by weight. Preferably, silicon is present in amounts of 0.6% and higher up to about 0.9 or 1%. A preferred range is 0.6 to 0.9 or 1%. Magnesium is present in amounts of 0.5 to 1.3%, broadly speaking, and 0.7 or 0.8% up to 1.1 or 1.2%, speaking more narrowly. A preferred range for magnesium is 0.8 to 1.1%. In addition to the respective percentages for silicon and magnesium, it is preferred in practicing the invention that silicon be present in excess over that amount theoretically consumed as $Mg_2Si$. However, it is also important that the extent of the excess be relatively slight. This is largely effected by controlling the amount of magnesium to exceed the amount of silicon by 0.1 to 0.4%, although at the highest Mg-lowest Si corner of the composition window a slight excess of Mg is tolerated. The signficance of this relationship is in providing for high yield and tensile strengths. Limiting the silicon excess to a small excess provides for combining such strength with improved toughness and impact resistance. Copper is present, speaking in the broadest terms, from about 0.6 to 1.1 or possibly 1.2%, although it is substantially preferred to keep the copper to 1% or less with a maximum of 0.9% or less or 0.95% or less being preferred. A preferred range for copper ranges from a minimum of 0.7 or 0.75 or 0.8% up to 0.9% or less or 0.95% or less. Copper in amounts of less than 0.6 or 0.7% results in impeded aging response in that copper present above 0.6 or 0.7%, preferably above 0.75%, imparts a highly desired flat aging curve described hereinbelow. In addition, copper contributes to the strength and durability of the improved products. However, copper in aluminum alloys is generally considered to impair corrosion resistance. For instance, Alloy 2024 nominally containing 4.4% copper has very good strength, toughness and impact resistance, but is often clad with pure aluminum for corrosion protection. While this may be suitable in products such as air frames where the added expense of the cladding operation can be absorbed, it is often considered an economic disadvantage in less costly products such as the lower cost aluminum heat treatable alloy products characterized by 6XXX alloys. In the improved products, as copper exceeds 0.9 or 0.95% or 1%, the products become more prone to corrosion problems. For instance, increasing copper from 0.9% to about 1.4% can increase general corrosion damage (measured by strength loss) by as much as 45% to 80%. Also, copper in amounts over 0.9 or 1% can reduce the toughness because of coarse intermetallic particles. Accordingly, it is preferred to keep copper below 1%, preferably below 0.9% especially where corrosive environments are encountered. Thus, within the herein set forth limits, copper can improve both the strength along with the impact resistance and toughness of the improved products, provided, however, that the thermal treatments as described hereinbelow are carefully followed. Manganese is present from a minimum of about 0.1 or 0.2 up to a maximum of about 0.9 or 1%. Speaking more narrowly, a range of 0.2 to 0.8 or 0.9% is suitable. A range of 0.25 or 0.3% to 0.45 or 0.5% or 0.6% is preferred for better strength.

Iron can be present up to about 0.5 or 0.6%, but it is preferable to keep iron below 0.4 or 0.3%. For better toughness, it is preferred that manganese plus iron be less than 0.8 or 0.9. Other elements include 0.01 or 0.02% titanium boride with a Ti:B weight ratio of 25:1. Chromium should not exceed 0.1 or preferably 0.05%. Zinc is preferably limited to 0.3% from a corrosion standpoint. The balance of the alloy is aluminum plus the incidental elements and impurities normally present in aluminum. In addition, the alloy can contain about 0.3 to 0.7% each of lead and bismuth to improve machining. A suitable range for lead and bismuth is 0.4 to 0.6%.

In practicing the invention it is important to employ a very high preheat or homogenizing temperature of about 1020° or 1030° F. to about 1080° F., preferably 1040° or 1050° to 1070° or 1080° F., which for this alloy is relatively close to the solidus or initial melting temperature insofar as use of industrial furnaces is concerned. FIG. 1 demonstrates how the solidus temperature varies for an Al-Mg-Si-Cu alloy containing 1% Mg, 0.9% Si, 0.35% Mn and varying amounts of copper. At 0.9% copper the alloy starts to melt at a little above 1075° F. and for 0.8% copper at about 1080° F. Hence, the preferred practice includes a high preheat within 30 or 40 degrees or less of the solidus temperature for the lower melting compositions of the invention, or on a less preferred basis, within 50° F. of the solidus, or (much less preferred) possibly 60°. Heating so close to the solidus temperature in an industrial mill furnace places the metal at risk with respect to overshooting the solidus temperature such that careful furnace controls may be required over those often employed with other 6XXX series and other conventional aluminum alloys in large industrial furnaces where 4 to 15 or more large ingots are heated at one time. In the type of furnace normally employed in heating commercial quantities of large ingots, large thermal heads of 50 degrees or even 100 degrees above the intended target temperature are typically employed to initially increase heatup rate with the furnace temperature controls being later reset to the target temperature. This practice is normally safe because the target temperature is typically 70 degrees to 100 degrees or more below the melting point and the resetting of the furnace precludes even getting close to the melting point, at least for any significant time period. However, it has been found that for the particular alloy products here concerned, the benefits of the invention with the very high heating temperature close to the solidus temperature outweigh the possible added expense and effort in furnace control in that substantially improved strength and toughness and impact resistance along with improvement in exfoliation corrosion resistance are achieved by heating the metal to temperatures relatively close to its solidus temperature. In addition to the above-mentioned corrosion problems associated with substantial amounts of copper in 6XXX alloys, referring to FIG. 1, it becomes apparent that amounts of copper around 1.4 or 1.5% reduce the melting point by 20 degrees in comparison with an alloy containing 0.9% copper. Heating an alloy containing 1.4 or 1.5% copper to preheating temperatures in the range of 1040° to 1070° F. virtually assures either destruction of the entire furnace load or serious damage as by liquation or incipient melting. Another observation in FIG. 1 is that alloys containing small amounts of copper such as 0.3% can be heated to relatively high temperatures such as 1040° to 1070° F. with virtually no risk as compared to the alloys in accordance with the invention.

One of the effects achieved by careful control of composition and thermal processing in accordance with the invention is substantial freedom from the Q-phase intermetallic constituent particle sometimes present in aluminum alloys containing substantial amounts of magnesium and silicon (6XXX alloys) and substantial amounts of copper. The particles can range in size from 1 micrometer or a little less to 30 micrometers or more. The average formula for the Q-phase has been reported as $Cu_2Mg_8Si_6Al_5$, but other formulas such as $Al_4CuMg_5Si_4$ have also been suggested [L. F. Mondolfo,

*Aluminum Alloys: Structure and Properties,* p. 644, published by Butterworths, (1976)].

An analysis of this phase by Guinier X-ray diffraction using a Guinier de Wolff Quadruple Focussing camera and using copper K radiation and 45 kilovolts and 20 milliamperes for a 10-hour exposure indicates the following pattern of d-spacings and line intensities:

| d spacings | line intensities | d spacings | line intensities |
|---|---|---|---|
| 9.25 | 10 | 2.185 | 5 |
| 5.23 | 25 | 2.12 | 40 |
| 3.70 | 50 | 2.06 | 2 |
| 3.405 | 2 | 1.96 | 60 |
| 3.195 | 2 | 1.875 | 2 |
| 3.00 | 5 | 1.832 | 25 |
| 2.60 | 100 | 1.56 | 10 |
| 2.50 | 5 | 1.40 | 20 |
| 2.40 | 5 | 1.244 | 10 |

When the herein set forth composition and thermal processing are followed, the amount of Q-phase should be substantially nil or negligible to further assure good toughness and corrosion performance.

The preheat or homogenizing temperature is applied to the ingot, either as cast or following a scalping or other treatment to smoothen its surface. The time at temperature is sufficient to get most of the soluble elements into solution and distributed. Typical hold times at the high preheat temperature can be about 4 hours, it being recognized that heating up to said temperature could readily exceed the hold time, especially for large ingot. After homogenizing or preheating, the ingot is hot worked into a wrought product employing rolling, extruding or forging procedures and the like normally employed in producing wrought aluminum products. However, in practicing the invention it is significant that high temperatures are preferably employed in these operations so as to not detract from improved conditions imparted by the high temperature preheat described above. In making sheet or plate products, the initial operation is hot rolling which should be initiated at a temperature of at least 850° F. and preferably a temperature of 875° to 1000° F. or more to reduce growth of magnesium-silicon particles. After the reversing mill, the plate while still hot or warm is typically continuously rolled in a multi-stand mill, and in practicing the invention, it is desired that the temperature exiting the continuous mill preferably not be less than 450° or 400° F. In the case of a sheet product, the metal exiting the hot continuous mill, typically around ⅛ inch in thickness, is cold rolled to final gauge.

The sheet or plate product is then solution heat treated at a relatively high temperature, preferably within the same range as described above for the homogenizng operation, but the time can be shortened substantially such as a time at metal temperature of 10 minutes or less being satisfactory for thin members like sheet with more time being suitable for thicker sheet or plate. Thereafter, the alloy is quenched, and it is significant that the present alloy is sensitive to quenching, such that a rapid chill rate of at least 100° F. per second is advisable and preferred. That is, while many products of the 6061 and 6063 type can be air quenched, the products produced in accordance with the present invention are preferably water quenched, although in the case of very thin members, a high energy air quench can suffice.

Although very high preheat temperatures are preferred, in the case of extrusions, homogenizing temperature can be a little lower than in the case of sheet or plate ingot, and possibly as low as 1020° F. or even perhaps 1010° F. under ideal conditions. This is because the extrusion operation proceeds much more rapidly and with less temperature loss than the hot rolling operation so as to minimize degradation of the homogenizing effects achieved in the preheat treatment. Extrusion is effected at temperatures of 850° F. minimum with the preferred temperatures of 875° to 1000° F. and higher being useful. As the extrusion exits the extrusion press, it can be press quenched, which is preferably a water press quench, although, as indicated above, a substantially less preferred practice includes an air quench which can be adequate, especially where thin extrusions are involved. In the case of hollow or tube-type extrusions, the extrusion can be further elongated and thinned by drawing through one or more dies over a mandrel, an operation which is performed at room temperature. Drawing reductions are typically 5 to 60% or more in wall thickness with or without change in diameter.

In the case of forged products, such normally start with stock provided as ingot or by extrusion or possibly hot rolled plate. Forging should be carried out at temperatures of at least 850° and preferably 900° to 1000° F. The forging stock is typically heated to about 1000° F. for the forging operation, forged and preferably cooled rather rapidly. If the stock, such as an extrusion, is previously solution heat treated and quenched, the forging operation, because of its quickness, in some cases may be performed without substantially impairing results of such earlier solution heat treatment and quenching. However, where the highest possible properties are desired, it is preferred that forging in any event be followed by a separate solution heat treating and quenching operation.

As is known, solution heat treating and quenching and natural aging produce a temper referred to as the T4 temper in which the heat treatable alloy exhibits a moderate level of strength which is further increased by artificial aging. It is generally recognized that a shaping operation can be interposed between solution heat treating and artificial aging operations to advantage since the moderate strength and higher workability of the T4 temper facilitate such which can be followed by the strength improving operation of artificial aging to produce the T6 type temper. Such shaping operations can include bending, stretch forming, roll forming whereby a sheet is rolled to a ribbed or corrugated shape, swaging to taper a section along its length, or any of the other operations known to be useful in shaping aluminum alloys in T4 temper into a desired configuration prior to artificial aging.

In artificial aging, aluminum alloys are normally heated to a temperature typically in the range of 220° up to about 350° or 400° F. for a period of time ranging inversely with temperature from about 30 or 40 hours down to about 3 to 5 hours. Aging at the higher end of this temperature range has an advantage of markedly shortened furnace times and markedly improved economies. However, most of the alloys and particularly the 6XXX type alloys at high aging temperatures run a serious risk of undershooting or overshooting the time required for the desired properties so as to degrade properties. This is because of the tendency of most aluminum alloys to peak out and decline in properties as the artificial aging process progresses with time. As the temperature of the process is increased, the property levels more rapidly increase to a peak level and then rapidly deteriorate such that it becomes more important to hit the theoretical or peak time exactly. An increase of as little as 25° to 40° F. in aging temperature can substantially reduce the peak aging time with an equally marked increase in sensitivity to overshooting or undershooting the required time. The picture can be further complicated, especially at the higher temperatures, to sensitivities in temperature control. More explanation concerning these effects can be seen in U.S. Pat. No. 3,645,804 to Ponchel. In industrial applications, it is difficult to hit an exact aging time and the higher temperature aging practices are normally not employed with 6XXX alloys despite their potential advantages since the rejection rate associated with high temperature aging can be troublesome. For Alloys 6009 and 6010 the aging temperature used in production is 350° F. and for 6061 and 6063 it is 345° F. This is based largely on the sensitivity to aging at higher temperatures such as 375° F.

One of the very important advantages in practicing the invention is that the improved products in accordance with the invention include a very stable furnace aging time profile, even at a relatively high artificial aging temperature of 375° F. or 400° F. For instance, in referring to FIGS. 2 and 3, it can be seen that the time curve for the improved products, even at high aging temperatures such as 375° or 400° F., are flat as compared to alloys 6009, 6010 and 6061 also shown in FIG. 2. The flat aging response of the improved alloys is a very significant advantage enabling the achievement of cost-savings of short-time high temperature aging without the previously associated serious risk of undershooting or overshooting the required time and the resulting degradation in properties and increased rejection rate which obviously decrease productivity.

To demonstrate the practice of the invention and the advantages thereof, aluminum alloy products were made having the following compositions:

TABLE III

| Alloy | Product | Si | Mg | Cu | Mn | Fe | Zn | Ti | Al |
|---|---|---|---|---|---|---|---|---|---|
| A | Sheet | 0.78 | 1.03 | 0.98 | 0.35 | 0.22 | 0.05 | 0.05 | Balance |
| B | Sheet | 0.80 | 0.96 | 0.68 | 0.33 | 0.26 | 0.03 | 0.01 | " |
| C | Plate | 0.76 | 0.94 | 0.98 | 0.34 | 0.23 | 0.02 | 0.04 | " |
| D | Plate | 0.77 | 0.99 | 0.72 | 0.38 | 0.23 | 0.01 | 0.04 | " |
| E | Extrusion | 0.76 | 0.93 | 0.89 | 0.37 | 0.27 | 0.04 | 0.01 | " |
| F | Extrusion | 0.76 | 0.96 | 0.99 | 0.35 | 0.23 | 0.03 | 0.01 | " |
| G | Extrusion | 0.77 | 0.94 | 0.94 | 0.37 | 0.21 | 0.03 | 0.01 | " |

In the foregoing Table, Alloys A through G represent practices within the invention. The alloys made into sheet or plate products (A through D) were semi-continuously D.C. cast into large sheet-type ingots, whereas the products made into extrusions (Alloys E, F and G) were cast into 9-inch round cross-section ingots. In both cases, the ingots were homogenized at a temperature of 1050° to 1060° F. as described herein. Sheet was produced by hot rolling the ingot at commencement temperatures of 875° to 1000° F. in the reversing mill followed by continuous hot rolling. Alloy A was made into sheet by hot rolling and continuously hot rolling to a thickness of about 0.15 inch followed by cold rolling from 0.15 to 0.1 inch thickness, a 33% cold reduction. Alloy B was hot rolled to its final gauge of 0.17 inch sheet. Alloys C and D were hot rolled on a reversing mill to provide plate 3 inches in thickness. Alloys E, F and G were extruded at temperatures between 850° and 1000° F. into long stock ¼ inch by 6 inches in section. All the products were solution heat treated at 1060° F. followed by water quenching. All of the products for Alloys A through G were artificially aged at 375° F. for 4 hours to produce the T6 temper except for Alloy D which was aged for 11 hours at 375° to T6. Tensile strength (TS) and yield strength (YS) in ksi (thousands of psi) and percent elongation (EL) for these products are set forth in Table IV. In the case of the thick plate members, Alloys C and D, tensile specimens were taken at the half-thickness point. The extrusions were measured only for longitudinal properties, which are usually those of most interest in extrusions of the size concerned.

TABLE IV

| | | STRENGTH | | | | | |
|---|---|---|---|---|---|---|---|
| | | Transverse | | | Longitudinal | | |
| Alloy | Gauge (Inch) | TS, ksi | YS, ksi | EL, % | TS, ksi | YS, ksi | EL, % |
| A | 0.1 | 62.0 | 54.0 | 15.5 | 62.8 | 56.2 | 14.0 |
| B | 0.17 | 60.3 | 50.1 | 14.0 | — | — | — |
| C | 3.0 | 57.9 | 52.7 | 3.8 | 59.8 | 52.1 | 11.0 |
| D | 3.0 | 58.6 | 54.0 | 7.3 | 57.6 | 54.8 | 10.2 |
| E | 0.25 | — | — | — | 59.9 | 56.0 | 13.2 |
| F | 0.25 | — | — | — | 60.9 | 57.2 | 12.7 |
| G | 0.25 | — | — | — | 61.0 | 57.3 | 13.7 |

In addition, tear toughness tests were performed on Alloys A, B, F and G, and the results are set forth in Table V. Yield (YS) strength was measured on a specimen taken directly adjacent to the tear test specimen to provide more meaningful ratio of tear strength (ksi) divided by yield strength (ksi). Unit propagation energy (U.P.E.) in inch pounds divided by inch square is also included in Table V.

TABLE V

| | | TEAR TOUGHNESS | | | | | | | |
|---|---|---|---|---|---|---|---|---|---|
| | | Transverse | | | | Longitudinal | | | |
| Alloy | Product | YS | Tear Strength | Tear/ Yield | U.P.E. | YS | Tear Strength | Tear/ Yield | U.P.E. |
| A | Sheet | 54.1 | 84.4 | 1.56 | 510 | 56.3 | 84.6 | 1.50 | 979 |
| B | Sheet | 54.1 | 81.5 | 1.51 | 390 | 56.1 | 84.9 | 1.51 | 925 |
| F | Extrusion | 51.2 | 85.1 | 1.66 | 445 | 57.1 | 85.2 | 1.49 | 1310 |
| G | Extrusion | 51.5 | 85.7 | 1.66 | 745 | 57.3 | 85.8 | 1.50 | 1430 |

Plane strength fracture toughness test results on Alloys C and D-T651 are set forth in Table VI, which also includes results for Alloy 2024 in the T351 temper. Tests were performed for the CLT, CTL and CSL positions. In these designations the first letter refers to the sample location; C means center of thickness. The second letter refers to the load direction; L means longitudinal; T means transverse; and S means short transverse load direction. The third letter refers to the direction of crack propagation; L means longitudinal propagation; T means transverse propagation. Yield strength specimens were taken adjacent to and in the same orientation as the fracture toughness samples. Table VI shows that the improved Alloys C and D compare very favorably with Alloy 2024 from the standpoint of strength and fracture toughness, it being worth noting that Alloy 2024-T351 is generally recognized to have very good fracture toughness.

TABLE VI

FRACTURE TOUGHNESS

| Alloy | Gauge (Inches) | Location & Orientation | YS, ksi | $K_{IC}$ |
|---|---|---|---|---|
| C | 3 | CLT | 53.6 | 51.2 |
| | | CTL | 54.5 | 32.5 |
| | | CST | 51.3 | 26.9 |
| D | 3 | CLT | 54.8 | 38.2 |
| | | CTL | 54.0 | 28.2 |
| | | CSL | 52.0 | 23.0 |
| 2024 | 3 | CLT | 53.5 | 34.8 |
| | | CTL | 46.6 | 29.8 |
| | | CSL | 43.4 | 22.2 |

For comparison purposes respecting Tables IV through VI, typical strength and tear strength toughness properties for Alloys 2024, 7475, 6061, 6063, 6009 and 6010 are set forth in Tables VII and VIII.

Impact resistance is another property often significant in the use of sheet-type products in applications such as automotive bumpers or even certain automotive panels. Table IX sets forth tests comparing Alloys A and B in accordance with the improvement with Alloy 6010. The static indentation test is described in SAE Paper No. 780140 (1978) entitled "Structural Performance of Aluminum Bumpers" by M. L. Sharp, J. R. Jombock and B. S. Shabel. This test is a dependable indication of the ability of a flat sheet to sustain an impact. In this test a thickness compensated cracking load is calculated as load to cracking ($L_c$) in kilopounds divided by thickness to the 4/3 power. In Table IX it can be seen that improved products A and B exhibit substantially improved performance in impact testing over Alloy 6010.

TABLE VII

STRENGTH (TRANSVERSE)

| Alloy | Product | TS, ksi | YS, ksi | EL % |
|---|---|---|---|---|
| 2024-T3 | Sheet | 66.1 | 46.7 | 17.8 |
| 7475-T61 | Sheet | 82.2 | 73.6 | 13.0 |
| 6061-T6 | Sheet | 47.8 | 43.1 | 14.1 |
| 6063-T6 | Extrusion | 38.1 | 34.4 | 12.9 |
| 6009-T6 | Sheet | 44.6 | 39.9 | 12.2 |
| 6010-T6 | Sheet | 52.1 | 48.1 | 11.9 |

TABLE VIII

TEAR STRENGTH

| Alloy | Product | Specimen Orientation | Tear Strength (ksi) | U.P.E. (in-lb./in.$^2$) |
|---|---|---|---|---|
| 2024-T3 | Sheet | T | 72.8 | 678 |
| 7475-T61 | Sheet | T | 93.1 | 455 |
| 6061-T6 | Sheet | T | 70.6 | 667 |
| 6063-T6 | Extrusion | L | 57.1 | 1345 |

TABLE VIII-continued

TEAR STRENGTH

| Alloy | Product | Specimen Orientation | Tear Strength (ksi) | U.P.E. (in-lb./in.$^2$) |
|---|---|---|---|---|
| 6010-T6 | Sheet | T | 72.6 | 220 |

TABLE IX

STATIC INDENTATION RESULTS (IMPACT)

| Alloy | Product | Gauge | Orientation | TS | Cracking load, Kips in.$^{4/3}$ |
|---|---|---|---|---|---|
| A-T6 | Sheet | 0.10 | T | 61.3 | 90.9 |
| B-T6 | Sheet | 0.17 | T | 59.0 | 82.2 |
| 6010-T6 | Sheet | 0.17 | T | 56.2 | 66.52 |

TABLE X

BEND FORMABILITY

| Alloy | Gauge (inches) | Minimum Bend Radius | Springback |
|---|---|---|---|
| A-W* | 0.10 | 1.00 t** | 1–2° |
| A-T4 | 0.10 | 0.50 t | 4–5° |
| 6010-T4 | 0.10 | 1.3 t | 4–5° |

*W designates solution heat treated and quenched without natural aging to stable strength.
**No fracture but slight orange peel at 0.5 t.

Still another area of concern with respect to any general purpose alloy is that of bend formability. Table X sets forth a comparison between Alloys A and B in accordance with the improvement and 6010, including the minimum bend radius without fracture (smaller is more bendable) and the amount of springback. It is readily apparent that the improved product's bendability is superior to Alloy 6010.

From all the foregoing comparison tables, the advantages of the invention are made readily apparent. The improved products compare very favorably in tensile strength and toughness with heat treatable Alloy 2024 a more expensive alloy often employed for aerospace type applications. The improved products exhibit significantly improved strength over Alloys 6009 and 6010 and very substantially improved strength properties over Alloys 6061 and 6063 while also exhibiting high tear strength substantially greater than Alloy 6010 which on the other hand exhibits better strength than 6061 and 6063. Also the improved products exhibit much better impact resistance and bendability or workability than Alloy 6010. Alloy 7475 is generally considered very high in tear strength, but the improved products appear to fall half-way between 2024 and 7475, both of which are aerospace alloys. Thus, the improved products, while not as strong as the more expensive 7475 alloy, compare very favorably with aerospace Alloy 2024 and represent a substantial improvement over Alloy 6061, 6063, 6009 and 6010 in combining high yield strength with high toughness and impact resistance. The improved products exhibit typical T4 properties of 25 ksi or more yield strength, 47 ksi or more tensile and 20% or more elongation. Typical T6 properties are 47 or 48 ksi or more yield strength, 55 ksi or more tensile and 12% or more elongation together with toughness characterized by a U.P.E. of 400 or more in the transverse direction and 800 or more in the longitudinal direction. This toughness is about the same as for alloys 6061 and 6063 but at much greater strength levels. The improved 6XXX alloy products are considered to combine the toughness and workability benefits of 6061 and 6063 alloys with even better strength and impact resistance than 6010 alloy so as to achieve structural performance levels considerably better than existing commercial 6XXX aluminum alloys.

Corrosion properties are, of course, significant with any aluminum alloy, and Table XI sets forth corrosion tests performed on certain of the improved products. The tests included exfoliation corrosion resistance and resistance to stress corrosion cracking.

Exfoliation is a type of corrosion where delamination occurs parallel to the surface of metal wherein flakes of metal peel are pushed from the surface. The sea water acidic acid test (SWAAT) was utilized and the results are set forth in Table XI wherein all improved products had slight or no pitting and no exfoliation after 1 day and 5 days, which is accepted as indicating high resistance to exfoliation corrosion in this test.

In the stress corrosion cracking tests a measured stress of up to 75% yield strength was applied to samples in a 6% boiling sodium chloride solution under constant immersion conditions and in an alternate immersion test in a 3½% solution of sodium chloride. In addition, stressed samples were exposed for 20 months to the sea coast atmosphere at Point Judith, R.I. The designation F/N refers to the number of failures for the number of samples.

TABLE XI

CORROSION RESISTANCE (EXFOLIATION & SCC)

| | Exfoliation* | | Stress Corrosion Cracking | | | |
|---|---|---|---|---|---|---|
| | | | | 168-hour test Boiling 6% NaCl Solution Constant Immersion | 90-day Alternate Immersion 3½% NaCl | Point Judith atmospheric test 20 months |
| Alloy | 1 Day | 5 Days | Stress Level, ksi | F/N | F/N | F/N |
| A | P | P | 40 | 0/2 | 0/5 | 0/5 |
| | | | 30 | 0/2 | 0/5 | 0/5 |
| | | | 20 | 0/2 | 0/5 | 0/5 |
| B | P | P | 40 | 0/2 | 0/5 | 0/5 |
| | | | 30 | 0/2 | 0/5 | 0/5 |
| | | | 20 | 0/2 | 0/5 | 0/5 |
| F | N | P | 40 | — | 0/2 | — |
| | | | 30 | — | 0/2 | — |
| | | | 20 | — | 0/2 | — |

*N = no attack; P = pitting

It can be seen from the foregoing Table XI that the improved products demonstrate very good resistance to both exfoliation and to stress corrosion cracking. In general, the improved products exhibit exfoliation and stress corrosion cracking resistance which are essentially like Alloy 6061 and a general corrosion resistance which is probably slightly below the level of 6061, which is a small penalty to pay for the greatly improved structural capabilities of the present improvement.

A major concern in heat treatable aluminum alloys, especially where cost is concerned, is the aging response, both with respect to room temperature aging and with respect to artificial aging at elevated temperatures. Stability of strength properties is a significant consideration with respect to room temperature aging in that after solution heat treating and quenching the properties will be observed to increase quickly for a while and then taper off in their rate of increase. It is desired that once the early increase occurs, the properties remain relatively flat with respect to time or stable. The yield strength of the improved products increases by only 3,000 psi or less between 3 weeks after quenching and 1 year after quenching, an indication of good stability.

The performance of the improved alloys during artificial aging treatments is considered highly significant in that the improved alloys exhibit a very stable time profile even at high aging temperatures. This is demonstrated in FIGS. 2 and 3 which illustrate artificial aging response in terms of yield strength as such varies with aging time at aging temperatures of 375° and 400° F., respectively, for FIGS. 2 and 3. Alloy H in accordance with the invention contains 0.7% Si, 0.88% Mg, 0.82% Cu, 0.33% Mn, 0.26% Fe, 0.06% Zn, 0.02% Ti, balance essentially aluminum. Alloy I is very similar to Alloy H except for being essentially free of copper. Alloy I contains 0.69% Si, 0.86% Mg, 0.01% Cu, 0.34% Mn, 0.22% Fe, 0.04% Zn, 0.01% Ti, balance essentially aluminum. Both were processed in accordance with the invention. Curves for Alloys 6061, 6009 and 6010 are included for further comparison.

Figure 2:
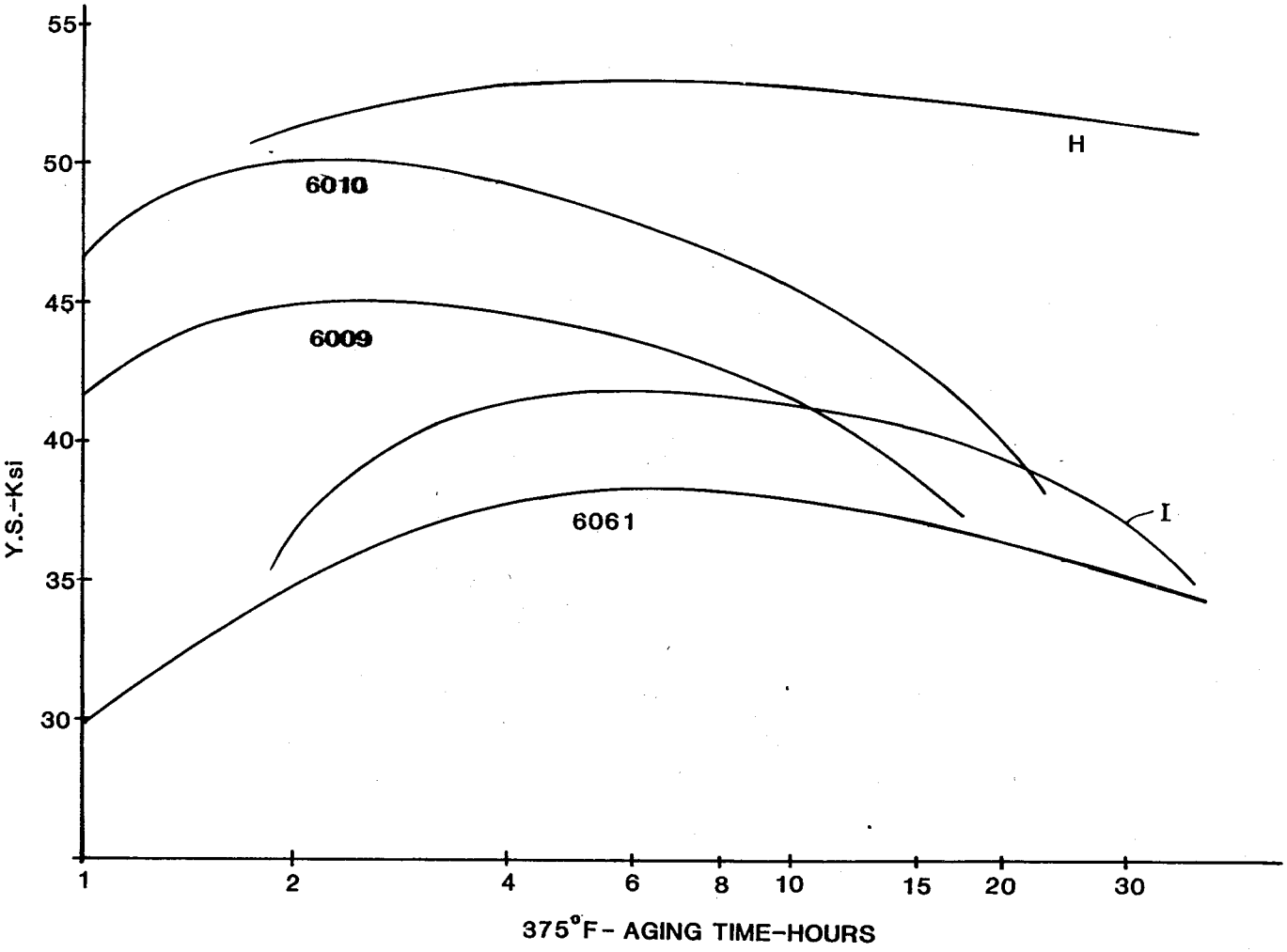
FIGS. 2 and 3, respectively, are graphs plotting yield strength versus time at 375° F. and 400° F. aging temperatures.

In FIG. 2 for aging at 375° F. it can be readily appreciated that the improved products designated by curve H exhibit a very stable aging response past two hours, and an essentially flat aging response past 3 or 4 hours. This contrasts with Alloy 6010 and Alloy 6009 which peak out at 2 or 2½ hours and drop off quite substantially at around 8 to 15 hours. Alloy 6061 peaks much later, around 6 to 8 hours, but also falls off, although not nearly as rapidly as Alloys 6009 and 6010. Obviously, Alloy 6061 never approaches the peak strength of Alloys 6009 or 6010, nor the stable strength of improved product H. Curve I pertains to an alloy very much like Alloy H except for eliminating copper and it, too, is characterized by the peak strength profile similar to Alloys 6010 and 6009 which contain more copper than Alloy I and less than Alloy H.

Figure 3:
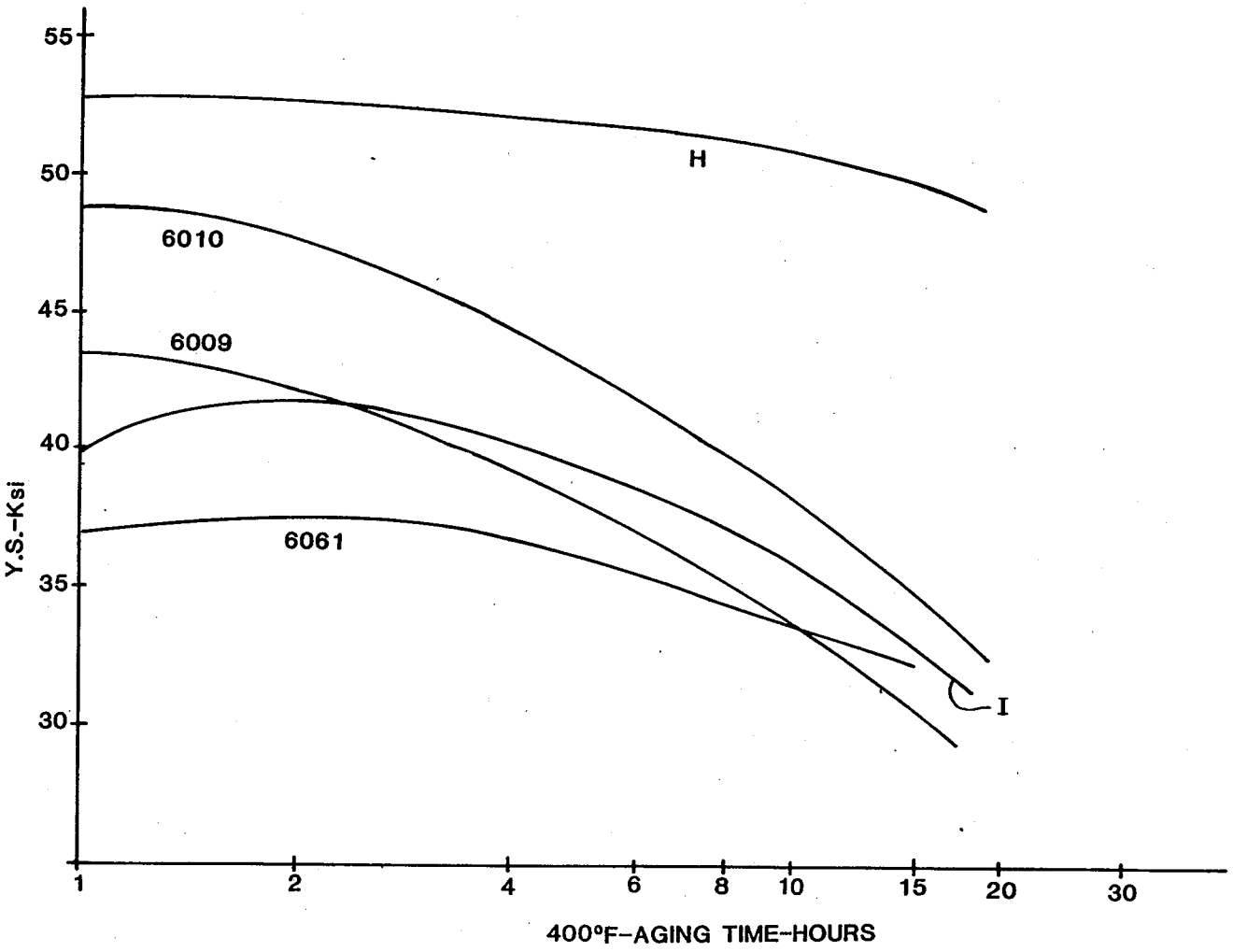

FIG. 3 for 400° F. aging illustrates results similar to FIG. 2 except they are somewhat amplified by the 25° temperature increase. Alloys 6009 and 6010 are moving past their peak strength levels at only 1 hour's aging time and exhibit a serious decline in strength with the passage of further aging time. However, product H in accordance with the invention illustrates an almost flat aging response from 1 to 8 or possibly 10 hours and very little deterioration even after 20 hours at 400° F. The degradation of Alloy 6061's properties is not as pronounced as that for Alloys 6009 and 6010, but is still considered significant, especially since 6061 already suffers a serious strength penalty in comparison with either Alloy 6009 or 6010 and a very marked penalty respecting product H in accordance with the invention. Again, curve I designates an alloy composition similar to that for curve H except for the substantial omission of copper.

From FIGS. 2 and 3 it is apparent that the present invention provides for a much more stable artificial aging response at high aging temperatures above 360° or 365° F., such as temperatures of 375° to 400° F. and a little higher. This renders it much easier in commercial practice to artificially age the improved products to their desired high strength properties without concern for overshooting or undershooting the ideal target. This obviously enables achieving the obvious economic advantages of artificially aging at higher temperatures while avoiding the serious productivity penalties encountered in rejections when products are aged too far past their peak strength, with resultant weakening. Also, it enables more tolerance of fluctuations in aging furnace temperatures even when attempting to use lower temperatures of 340° or 350° F. That is, some of the sensitivity to aging time for conventional products can be lessened by use of temperatures of about 350°, but this margin of safety is lost if the temperature wanders up to 370° or 380° F. The present improvement provides extremely wide latitude in aging time and temperature.

The products in accordance with the invention are highly suited as vehicular panels. Vehicular panels are described in U.S. Pat. No. 4,082,578, incorporated herein by reference, and include floor panels, side panels, or other panels for cars, trucks, trailers, railroad vehicles and canoe or boat panels, aerospace panels and other shaped sheet and extrusion members, forgings and other members. Normally, such products are shaped to provide a curved or other profile in the T4 temper which is then followed by artificial aging to the T6 temper. Shaping is effected by stamping, stretch forming, bending or any of the known techniques. The stretch formability of the improved sheet products is considered quite significant for products of such strength. Stretch forming includes stretching the metal over a typically male die at room temperature much like stretching a plastic film over a curved shape. The improved products in T4-type condition are readily stretch formed into canoe, aircraft or other panel shapes.

Figure 4:
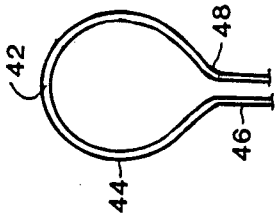
FIG. 4 is an elevation view of a sports racket frame.

Further examples of applications of the improved products include sporting goods such as racket frames for tennis, racquetball and other racket sports. Referring to FIG. 4, in making such racket frames, metal stock 42 is bent or shaped into a closed or nearly closed curved generally circular or oval loop or hoop 44 with the end portions of the stock reverse bent through arc 48 to form substantially straight outwardly extending substantially parallel appendages or arms 46 in the plane of the hoop to provide handle stock to which a hand grip handle is affixed. Strings or filaments are tensioned across the hoop through holes provided in the metal stock to adapt the racket for striking a projectile. The metal stock so bent can be an extruded "I" or the "dog bone" shape familiar in rackets or an oval tube shape provided by squeezing a round tube shape. The tube can be provided as an extrusion in T4 or T6 type tempers or as an extruded and drawn tube in T4, T6 or T8 type tempers. Such tube is made by extruding a hollow shape around 1¼ to 2 inches outer diameter by around ⅛ to 3/16 inch thick and drawing the extruded stock down to about 9/16 to ¾ inch outer diameter by around 0.03 to 0.06 inch thick. The drawn tube can be solution heat treated, quenched and naturally aged to T4 temper or it can be artificially aged to the T6 temper or the quenched material can be cold worked by further drawing 10 to 40% thickness reduction followed by artificially aging to a T8 type temper. The drawn round tube can be sized to provide an oval shape by pulling through a sequence of reshaping dies. The present improvement includes so bending and shaping stock provided in accordance with the herein-described procedures and improvements.

Another application for the improvement occurs in ski poles where extruded and drawn tube about ⅝ to 1 inch outer diameter by 0.030 to 0.08 inch thick is tapered with or without first further drawing, the tapering being effected as by cold swaging along the tube length to provide the customary tapered ski pole configuration to which a handle is attached to the large or top end and a point or "punch" attached to the bottom end or fashioned from the tube stock itself. A basket is attached a few inches above the bottom. The improvement includes so shaping tube stock provided in accordance with the herein-described procedures and improvements. In similar fashion, baseball bats are made by providing an extruded or extruded and drawn tube which is swaged to provide the customary tapered profile.

The advantages in these sport equipment applications derive from the higher strength properties of the present improved aluminum stock together with its much improved toughness and dent resistance, which are achieved without penalty in corrosion properties. In the past, rackets and other sporting goods products have been made from 6XXX type alloys, but the present improvement allows for markedly improved strength, toughness and dent resistance over these products and does so without significant risk of corrosion or stress corrosion effects. For instance, previously substituting the stronger 7XXX alloys for the weaker 6XXX type alloys improved the strength and toughness of rackets and other sporting goods products, but this improvement in performance was accompanied by increases in costs inherent in the use of 7XXX alloys and increased susceptibility to stress corrosion cracking also inherent in the use of such alloys. The present improvement offers advantages over both of the previous choices providing very substantially improved performance at a substantial cost advantage over 7XXX alloys and even some cost improvement over some of the previous 6XXX alloys achieved by enabling the use of higher temperature-shorter time aging cycles.

In comparing the advantages of the present improvement over prior art with respect to racket material, the present improvement offers an advantage of 2,000 to 3,000 psi in strength over 7005 alloy in T6 temper and very substantially improved corrosion properties over 7005 alloy. In addition, while 6061 alloy used for racket sport applications does not have corrosion disadvantages, the present improvement achieves a 25 to 30% or more increase in strength over 6061. Equally significant is the fact that 7XXX alloys, when substituted for 6061, also include a forming penalty in that 7XXX alloys are more difficult to form and when so shaped exhibit residual stress in the frame.

The improved products provide for many improved structural members including shipping pallets and containers made by shaping sheet or extrusion members and riveting or welding the assemblies together. Improved aluminum pipe and tube stock ⅛ inch to 36 inches in diameter useful even in aerospace applications can be provided as extruded or extruded and drawn pipe or tube in accordance with the present improvement so as to provide the strength, toughness and impact resistance in accordance herewith. Compressed gas cylinders can be made from open cylinders provided as extruded or extruded and drawn tube or pipe or as sheet bent into a cylinder and welded. The open cylinder ends are closed by spin forming to provide high strength, durable gas pressure containers.

Many other applications of the improved products present themselves in view of the herein set forth advantages of the invention.

While the invention has been described in terms of preferred embodiments, the claims appended hereto are intended to encompass all embodiments which fall within the spirit of the invention.

What is claimed is:

1. In a method for producing a wrought aluminum alloy product, said method including solution heat treating and quenching, the improvement wherein:

(a) said alloy consists essentially of 0.4 to 1.2% silicon, 0.5 to 1.3% magnesium, the amount of magnesium exceeding the amount of silicon by 0.1 to 0.4%, from above 0.6% to 1.1% copper, 0.1 to 1% manganese, not more than 0.6% iron, the balance being essentially aluminum and incidental elements and impurities; and (b) said alloy is heated to a temperature in the range of 1020° to 1080° F. to dissolve soluble elements, said temperature being within 50° F. of the solidus temperature for said alloy;

said product in naturally aged condition exhibiting high strength and formability and good resistance to corrosion, said product in artificially aged condition exhibiting high strength, tear toughness, notch-toughness and impact resistance together with good resistance to corrosion, said product being capable of stable yield strength response to artificial aging treatment at temperatures above 360° F. for time periods of from about 2 hours or less up to 15 hours or more.

2. The method according to claim 1 wherein said alloy contains from above 0.6% to 0.9% copper.

3. The method according to claim 1 wherein said alloy contains from 0.2% to 0.7% manganese.

4. The method according to claim 1 wherein said alloy contains from 0.7% to 0.95% copper, from 0.2% to 0.65% manganese, and wherein iron plus manganese does not exceed 0.9%.

5. The method according to claim 1 wherein said heating is to a temperature of 1040° F. or more and within 40° F. of the solidus temperature for said alloy.

6. The method according to claim 1 wherein said heating is to a temperature of 1050° F. or more and within 30° F. of the solidus temperature for said alloy.

7. The method according to claim 1 wherein said product is not artificially aged.

8. The method according to claim 1 wherein said product is shaped into a shaped article and then artificially aged and in artificially aged condition exhibits strength greater than Alloy 6061-T6 and equal to or greater than Alloy 6010-T6 and tear toughness greater than Alloy 6010-T6 when fashioned as a similar product shaped similarly into a shaped article.

9. A method of producing a structural aluminum alloy member comprising the steps of:

(a) providing a body of aluminum base alloy consisting essentially of 0.4 to 1.2% silicon, 0.5 to 1.3% magnesium, the amount of magnesium exceeding the amount of silicon by 0.1 to 0.4% from above, 0.6% to 1.1% copper, 0.1 to 1% manganese, not more than 0.6% iron, the balance being essentially aluminum and incidental elements and impurities;

(b) heating said body to a temperature in the range of 1020° to 1080° F., said temperature being within 50° F. of the solidus temperature for said alloy;

(c) working said body to produce a wrought aluminum product;

(d) solution heat treating said wrought aluminum product at a temperature within the range of 1020° to 1080° F.; and (e) quenching said product.

10. The method according to claim 9 wherein said alloy member is formed into a shaped aluminum article.

11. The method according to claim 9 wherein said alloy member is formed into a shaped aluminum article and said shaping includes stretch forming.

12. The method according to claim 9 which includes a hot working operation initiated at a metal temperature above 850° F.

13. The method according to claim 9 wherein said quenching is effected at a quench rate of at least 100° F. per second.

14. The method according to claim 9 including the additional step of artificially aging said product, said product exhibiting a substantially stable aging time-yield strength pattern.

15. The method according to claim 9 including artificially aging said product at a temperature of 360° to 385° F., said product characterized by a substantially stable aging time-yield strength profile.

16. The method according to claim 9 wherein said silicon content of said alloy is 0.6 to 0.9%.

17. The method according to claim 9 wherein said magnesium content of said alloy is 0.7 to 1.2%.

18. The method according to claim 9 wherein said copper content of said alloy is from above 0.6% to 0.95%.

19. The method according to claim 9 wherein said manganese content of said alloy is 0.2 to 0.6%.

20. The method according to claim 9 wherein said manganese content of said alloy is 0.2 to 0.6% and manganese plus iron content does not exceed 0.9%.

21. The method according to claim 9 wherein said manganese content of said alloy is 0.4 to 0.7%.

22. The method according to claim 9 wherein said alloy additionally contains 0.3 to 0.7% each of lead and bismuth, said alloy exhibiting improved machining characteristics.

23. The method according to claim 9 wherein said manganese plus iron does not exceed 0.8%.

24. The method according to claim 9 wherein in at least one of said steps (b) or (d) said heating is to a temperature of 1040° F. or more and within 40° F. of the solidus temperature for said alloy.

25. The method according to claim 9 wherein in at least one of said steps (b) or (d) said heating is to a temperature of 1050° F. or more and within 30° F. of the solidus temperature for said alloy.

26. In the method of producing a sports racket frame wherein elongate aluminum stock is shaped into an arcuate hoop, said hoop being adapted for tensioning string members across its opening for striking a projectile, the improvement wherein said elongate aluminum stock is provided as an alloy consisting essentially of 0.4 to 1.2% silicon, 0.5 to 1.3% magnesium, the amount of magnesium exceeding the amount of silicon by 0.1 to 0.4%, from above 0.6% to 1.1% copper, 0.1 to 1% manganese, not more than 0.6% iron, the balance being essentially aluminum and incidental elements and impurities, said stock being in the condition resulting from operations comprising hot working, solution heat treating and quenching and including:

(a) heating said alloy to a temperature in the range of 1020° to 1080° F., said temperature being within 50° F. of the solidus temperature for said alloy;

(b) extruding said alloy to provide an elongate member;

said member in naturally aged condition exhibiting high strength and formability and good resistance to corrosion, said member in artificially aged condition exhibiting high strength, tear toughness, notch-toughness and impact resistance together with good resistance to corrosion, said member being capable of stable yield strength response to articifical aging treatment at temperatures above 360° F. for time periods of from about 2 hours or less up to 15 hours or more.

27. The method according to claim 26 wherein said extruding operation produces said elongate aluminum stock.

28. The method according to claim 26 wherein said extruding operation produces elongate tubular material which is cold drawn in producing said elongate aluminum stock.

29. The method according to claim 26 wherein said heating is to a temperature of 1040° F. or more and within 40° F. of the solidus temperature for said alloy.

30. In the method of producing a hollow elongate aluminum product wherein elongate hollow aluminum stock is shaped by tapering into an elongate hollow member including a tapered portion along its length, the improvement wherein said elongate aluminum stock is provided as an alloy consisting essentially of 0.4 to 1.2% silicon, 0.5 to 1.3% magnesium, the amount of magnesium exceeding the amount of silicon by 0.1 to 0.4%, from above 0.6% to 1.1% copper, 0.1 to 1% manganese, not more than 0.6% iron, the balance being essentially aluminum and incidental elements and impurities, said stock being in the condition resulting from operations comprising hot working, solution heat treating and quenching and including:

(a) heating said alloy to a temperature in the range of 1020° to 1080° F., said temperature being within 50° F. of the solidus temperature for said alloy;

(b) extruding said alloy to provide an elongate member;

said member in the naturally aged condition exhibiting high strength and formability and good resistance to corrosion, said member in artificially aged condition exhibiting high strength, tear toughness, notch-toughness and impact resistance together with good resistance to corrosion, said member being capable of stable yield strength response to artificial aging treatment at temperatures above 360° F. for time periods of from about 2 hours or less up to 15 hours or more.

31. The method according to claim 30 wherein said extruding operation produces said elongate aluminum stock.

32. The method according to claim 30 wherein said extruding operation produces elongate tubular material which is cold drawn in producing said elongate aluminum stock.

33. The method according to claim 30 wherein said tapering operation includes swaging.

34. The method according to claim 30 wherein said product in T6 condition exhibits a yield strength of 47 ksi or more, a tensile strength of at least 55 ksi and an elongation of 12% or more, together with high tear toughness characterized by a transverse U.P.E. of 400 or more and a longitudinal U.P.E. of 800 or more.

35. The method according to claim 30 wherein said heating is to a temperature of 1040° F. or more and within 40° F. of the solidus temperature for said alloy.

36. In a method for producing a shaped vehicular panel wherein a wrought aluminum product is formed to provide said panel, the improvement wherein said product is provided as an alloy consisting essentially of 0.4 to 1.2% silicon, 0.5 to 1.3% magnesium, the amount of magnesium exceeding the amount of silicon by 0.1 to 0.4%, from above 0.6% to 1.1% copper, 0.1 to 1% manganese, not more than 0.6% iron, the balance being essentially aluminum and incidental elements and impurities, said product being in the condition resulting from operations comprising working into a wrought product, solution heat treating and quenching and including a heating operation to a temperature of 1020° to 1080° F., said temperature being within 50° F. of the solidus temperature for said alloy, said product in the naturally aged condition exhibiting high strength and formability and good resistance to corrosion, said product in artificially aged condition exhibiting high strength, tear toughness, notch-toughness and impact resistance together with good resistance to corrosion, said product being capable of stable yield strength response to artificial aging treatment at temperatures above 360° F. for time periods of from about 2 hours or less up to 15 hours or more.

37. The method according to claim 36 wherein said alloy contains from above 0.6% to 0.9% copper.

38. The method according to claim 36 wherein said alloy contains from 0.2% to 0.7% manganese.

39. The method according to claim 36 wherein said alloy contains from 0.7% to 0.95% copper, from 0.2% to 0.65% manganese, and wherein iron plus manganese does not exceed 0.9%.

40. The method according to claim 36 wherein said wrought aluminum product is a flat product and is produced by operations comprising hot rolling initiated at temperatures above 875° F.

41. The method according to claim 36 wherein said heating is to a temperature of 1040° F. or more and within 40° F. of the solidus temperature for said alloy.

42. The method according to claim 36 wherein said heating is to a temperature of 1050° F. or more and within 30° F. of the solidus temperature for said alloy.

43. The method according to claim 36 wherein said wrought product is produced by working operations which include extruding at a temperature above 850° F.

44. The method according to claim 36 wherein said product in naturally aged condition exhibits a yield strength of at least 25 ksi, a tensile strength of at least 47 ksi and an elongation of 20% or more.

45. The method according to claim 36 wherein said product in artificially aged condition exhibits a yield strength of 47 ksi or more, a tensile strength of at least 55 ksi and an elongation of 12% or more, together with high tear toughness characterized by a transverse U.P.E. of 400 or more and a longitudinal U.P.E. of 800 or more.

46. The method according to claim 36 wherein said forming into said panel includes a stretch forming operation.

47. A wrought aluminum alloy product composed of an alloy consisting essentially of 0.4 to 1.2% silicon, 0.5 to 1.3% magnesium, the amount of magnesium exceeding the amount of silicon by 0.1 to 0.4%, from above 0.6% to 1.1% copper, 0.1 to 1% manganese, not more than 0.6% iron, the balance being essentially aluminum and incidental elements and impurities, said product being in the condition resulting from operations comprising solution heat treating and quenching and including a heating operation to a temperature of 1020° to 1080° F., said temperature being within 50° F. of the solidus temperature for said alloy, said product in the naturally aged condition exhibiting high strength and formability and good resistance to corrosion, said product in artificially aged condition exhibiting high strength, tear toughness, notch-toughness and impact resistance together with good resistance to corrosion, said product being capable of stable yield strength response to artificial aging treatment at temperatures above 360° F. for time periods of from about 2 hours or less up to 15 hours or more.

48. The product according to claim 47 wherein said product exhibits substantially nil Q-phase content.

49. The product according to claim 47 wherein said heating is to a temperature of 1040° F. or more and within 40° F. of the solidus temperature of said alloy.

50. The product according to claim 47 wherein said heating is to a temperature of 1050° F. or more and within 30° F. of the solidus temperature of said alloy.

51. The product according to claim 47 wherein said product in naturally aged condition exhibits a yield strength of at least 25 ksi, a tensile strength of at least 47 ksi and an elongation of 20% or more.

52. The product according to claim 47 wherein said product in artificially aged condition exhibits a yield strength of 47 ksi or more, a tensile strength of at least 55 ksi and an elongation of 12% or more, together with high tear toughness characterized by a transverse U.P.E. of 400 or more and a longitudinal U.P.E. of 800 or more.

53. The product according to claim 47 wherein said alloy contains from above 0.6% to 0.9% copper.

54. The product according to claim 47 wherein said alloy contains from 0.2% to 0.7% manganese.

55. The product according to claim 47 wherein said alloy contains from 0.7% to 0.95% copper, from 0.2% to 0.65% manganese, and wherein iron plus manganese does not exceed 0.9%.

56. The product according to claim 47 wherein said product is in the condition resulting from operations comprising homogenizing, hot working, solution heat treating and quenching and wherein said homogenizing and said solution heat treatment are each performed by heating to a temperature of 1040° F. or more.

57. The product according to claim 47 wherein said alloy additionally contains 0.3% to 0.7% each of lead and bismuth.

58. The improved sports racket frame produced according to the method of claim 26.

59. The improved elongate hollow article with a tapered portion produced according to the method of claim 30.

60. In the method according to claim 1 wherein a metal working operation follows said heating to a temperature in the range of 1020° to 1080° F. in producing said wrought aluminum alloy product.

61. In the method according to claim 1 wherein said heating to a temperature in the range of 1020° to 1080° F. is applied to a substantially unworked body of said alloy and is followed by metal working to produce said wrought product.

62. In the method according to claim 1 wherein said heating to a temperature in the range of 1020° to 1080° F. is performed in the solution heat treating operation.

63. In the method according to claim 1 wherein the production of said wrought product includes extrusion and wherein said heating to a temperature of 1020° to 1080° F. is performed prior to said extrusion and said quenching follows said extrusion.

64. In the method according to claim 63 wherein said quenching is performed substantially as the extrusion exits the extrusion press.

65. In the method according to claim 1 wherein a hot metal working operation follows said heating to a temperature in the range of 1020° to 1080° F. in producing said wrought aluminum alloy product.

66. The method according to claim 1 wherein said alloy product is formed into a shaped aluminum article.

67. The method according to claim 1 wherein said alloy product is formed into a shaped aluminum article and said shaping includes stretch forming.

68. The method according to claim 1 which includes a hot working operation initiated at a metal temperature above 850° F.

69. The method according to claim 1 wherein said quenching is effected at a quench rate of at least 100° F. per second.

70. The method according to claim 1 including the additional step of artificially aging said product.

71. The method according to claim 70 including artificially aging said product at a temperature of 360° to 385° F.

72. The method according to claim 1 wherein said silicon content of said alloy is 0.6 to 0.9%.

73. The method according to claim 1 wherein said magnesium content of said alloy is 0.7 to 1.2%.

74. The method according to claim 26 wherein said extruding is at a temperature of at least 850° F.

75. The method according to claim 30 wherein said extruding is at a temperature of at least 850° F.

76. The product according to claim 47 wherein said product is in a naturally aged condition.

77. The product according to claim 47 wherein said product is in an artificially aged condition.

78. The product according to claim 47 wherein said heating to a temperature of 1020° to 1080° F. is preformed in the solution heat treating operation.

79. The product according to claim 47 wherein said heating to a temperature of 1020° to 1080° F. is performed prior to a metal working operation.

80. The product according to claim 47 wherein said heating to a temperature of 1020° to 1080° F. is performed prior to a hot metal working operation.

* * * * *

UNITED STATES PATENT AND TRADEMARK OFFICE

CERTIFICATE OF CORRECTION

PATENT NO. : 4,589,932

DATED : May 20, 1986

INVENTOR(S) : Bom K. Park

It is certified that error appears in the above-identified patent and that said Letters Patent is hereby corrected as shown below:

| | |
|---|---|
| Title page, under References Cited | Insert --"A New Alloy For Use In Body Parts For Motor Vehicles", by M. Buratti et al., Alluminio, Volume 47, No. 10, pages 372-374.-- |

Signed and Sealed this

Fourth Day of November, 1986

[SEAL]

*Attest:*

DONALD J. QUIGG

*Attesting Officer*

*Commissioner of Patents and Trademarks*